United States Patent [19]

Itoh

[11] Patent Number: 4,773,773

[45] Date of Patent: Sep. 27, 1988

[54] PRINTER EQUIPPED WITH A MECHANISM FOR LOCKING THE CARRIAGE OF A PRINTING HEAD

[75] Inventor: Masayasu Itoh, Ohme, Japan

[73] Assignee: Kabushiki Kaisha Toshiba, Tokyo, Japan

[21] Appl. No.: 934,960

[22] Filed: Nov. 26, 1986

[30] Foreign Application Priority Data

Nov. 29, 1985 [JP] Japan ..... 60-184947[U]

[51] Int. Cl.[4] ..... B41J 29/56

[52] U.S. Cl. ..... 400/59; 400/663; 400/674

[58] Field of Search ..... 400/55, 56, 57, 58, 400/59, 60, 320, 352, 353, 354, 354.1, 356, 663, 674, 675, 679

[56] References Cited

U.S. PATENT DOCUMENTS 2,963,546 12/1960 Hodne ..... 400/663
4,452,542 6/1984 Akazawa ..... 400/354

FOREIGN PATENT DOCUMENTS 3235339 3/1984 Fed. Rep. of Germany ..... 400/352
351618 3/1961 Switzerland ..... 400/352

OTHER PUBLICATIONS

T. L. Wilmoth; "Carriage Locking Mechanism"; *IBM Technical Disc. Bull.*; vol. 22, No. 12, pp. 5229-5230; May 1980.

Anonymous, "Carriage Lock"; *IBM Tech. Disc. Bull.*; vol. 28, No. 7, pp. 2889-2890; Dec. 1985.

*Primary Examiner*—David A. Wiecking
*Attorney, Agent, or Firm*—Finnegan, Henderson, Farabow, Garrett, & Dunner

[57] ABSTRACT

The printer, in which a carriage carries a printing head and reciprocates along a guide rail, comprises a locking member attached in the vicinity of the end portion of the guide rail for locking the carriage temporarily, further comprises the locking member arranged to the position toward the locking member attached in the vicinity of the end portion of the guide rail. The locking member is attached to the lever which adjusts the print gap.

2 Claims, 4 Drawing Sheets

PRINTER EQUIPPED WITH A MECHANISM FOR LOCKING THE CARRIAGE OF A PRINTING HEAD

The present application claims priority of Japanese Utility Model Application No. 60-184947 filed on Nov. 29, 1985.

FIELD OF THE INVENTION

This invention relates to a printer of a serial printing system.

As the hard copy outputting unit for personal computers and word processors, the printer of a serial printing system has widely been used from the past.

The general structure of this printer is illustrated in FIG. 7. This drawing shows a printing head 1 of a wire dot impact system, a carriage 2 that loads the printing head 1 thereon and is reciprocated along the guide rail 3 by dint of a carriage motor (not shown in the figure), a paper 4 printed by the printing head 1, a platen 5 that is to be backed to the paper 4 when it is being printed, side frames 6*a* and 6*b* for retaining the guide rail 3 and the platen roller 5, and the lever 7 (to be called "copy lever" hereinafter) for displacing the guide rail 3 in the direction of the arrow marked "P" in order to adjust the gap between the tip of printing head 1 and the platen roller 5 in the event, for instance, that a plural number of sheets 4 among which the carbon papers inserted are to be printed in bulk.

In this printer, the printing is done on every other line against the sheet 4 while the carriage 2 loaded with the printing head 1 is being reciprocated in the direction of the arrow marked "Q".

By the way, when delivering this type of printer out of a factory, the carriage 2 is to be fixed temporarily against the frame so that the carriage 2 may not get displaced by vibrations in transit and may not damage the printing head 1 or the guide rail 3.

FIG. 8 is a view showing the state where this carriage 2 has been locked.

As known from this figure, in conventional printers the carriage 2 is fastened to the side frame 6*a* by a wire-bundling belt 8, or the movement of carriage 2 is prevented in transit by fitting a locking member 9 of polystyrene foam onto the guide rail 3.

However, the method of locking the carriage 2 by use of the wire-bundling belt 8 contains such problematic aspects that a great deal of labour is necessary in fastening the wire-bundling belt 8, the wire-bundling belt 8 must be cut in taking out the printer and it must be renewed every time when the carriage 2 needs to be locked.

Moreover, the method of fitting the locking member 9 onto the guide rail 3 involves a problem that the locking member 9 is likely to go astray.

OBJECT AND SUMMARY OF THE INVENTION

This invention has been done in view of the circumstances as mentioned above. It aims at providing a type of printer having a mechanism which can eliminate much labour when locking the carriage temporarily and can lock the carriage at any number of times when necessary.

In other words, this invention covers a printer, in which the carriage reciprocates along the guide rail installed in the unit body loaded with a printing head is provided with the locking member for locking the carriage temporarily at the given position of the guide rail in the vicinity of the guide rail of the unit body so that the carriage can be locked easily as necessary.

DETAILED DESCRIPTION OF PREFERRED EMBODIMENTS

Hereinafter, the details of embodiments according to this invention are to be described on the basis of the drawings.

Figure 1:
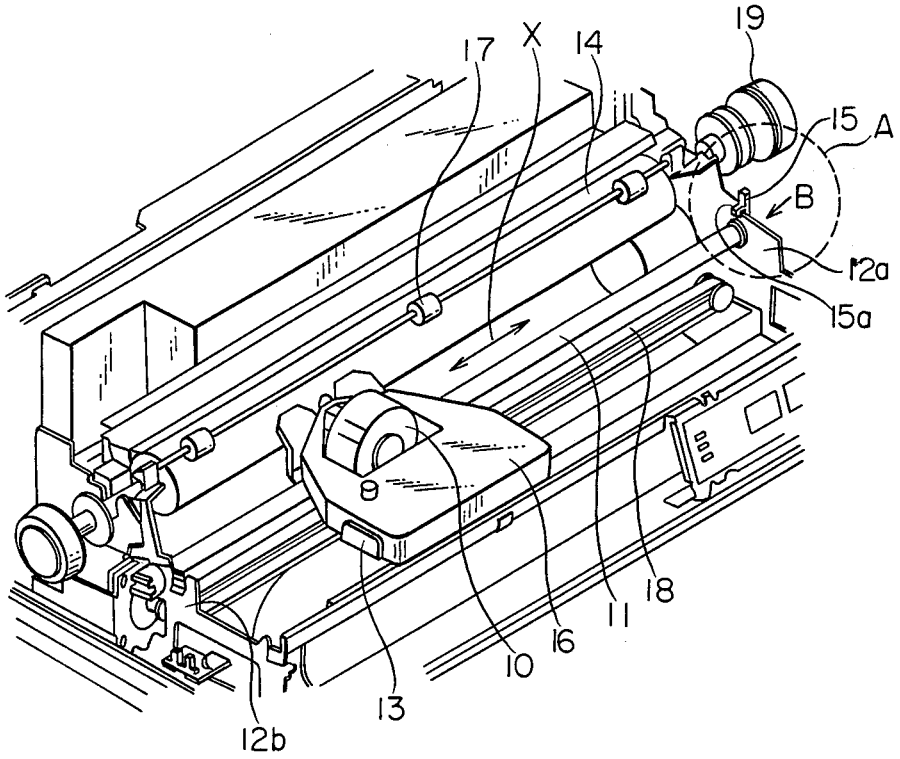
FIG. 1 is a perspective view showing the structure of one of the embodiments according to this invention, FIG. 2 a side view showing the state where the "A" area of FIG. 1 is expanded and viewed from the arrow mark "B" direction, FIG. 3 a perspective view showing the structure of the pivotal section of FIG. 1, FIG. 4 a perspective view explaining the control of the copy lever in the unit shown in FIG. 1, FIG. 5 a view for explaining the function by position of copy lever in the unit shown in FIG. 1, FIG. 6 an exploded perspective view showing the structure of the pivotal section of the unit as another embodiment of this invention, FIG. 7 a top view showing the structure of a conventional printer, and FIG. 8 a top view showing the state where the carriage of a printing head is locked in the unit shown in FIG. 7.
Figure 2:
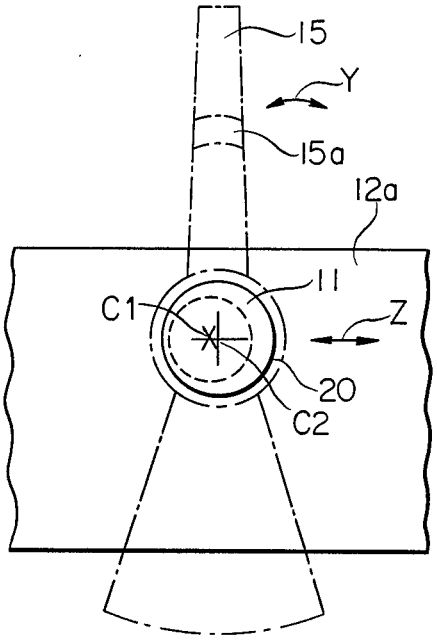
Figure 3:
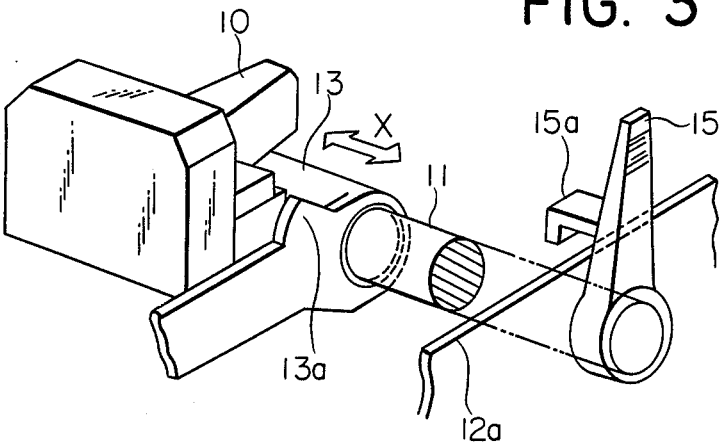

FIG. 1 is a perspective view showing the structure of one of embodiments of this invention, FIG. 2 is a side view showing the state where the "A" area of FIG. 1 is expanded and viewed from the arrow mark "B" direction, and FIG. 3 is a perspective view showing the structure of the pivotal section of FIG. 1.

The printer according to this embodiment, where the printing head 10 of wire dot impact system is loaded, is equipped with the carriage 13 being reciprocated along the guide rail 11 between a pair of side frames 12*a* and 12*b* of the unit body, the fan-shaped projecting member 13*a* provided in the vicinity of a side portion of carriage 13 (FIG. 3), the copy lever 15 that is engaged to the guide rail 11 for increasing and decreasing the gap between the tip of a printing head 10 and the platen roller 14, and the hook-shaped projecting member 15*a* formed against the copy lever 15 and being engaged with the projecting member 13*a* of carriage 13 at the position described later. A ribbon cassette 16 is mounted on carriage 13.

FIG. 1 also shows the bale roller 17 for retaining the papers when they are loaded between the carriage 13 and the platen roller 14, the carriage belt 18 for reciprocating the carriage 13, and the platen knob 19 for manually rotating the platen roller 14.

What is more, as known from FIG. 2 in the printer of this embodiment, the end portion of guide rail 11 is mounted to the copy lever 15 via an eccentric cam 20 while the center C1 of rotary movement of guide rail 11 is slightly offset from the center C2 of rotary movement of the copy lever 15.

Therefore, if the copy lever 15 is rotated and displaced in the direction of the arrow mark "Y", the guide rail 11 is shifted by some 0.3 mm maximum in the direction of the arrow mark "Z".

And in the printer of this embodiment, the carriage 13 is reciprocated in the direction of the arrow mark "X"

by the rotary movement of carriage belt 18 when the printing is carried out.

Figure 4:
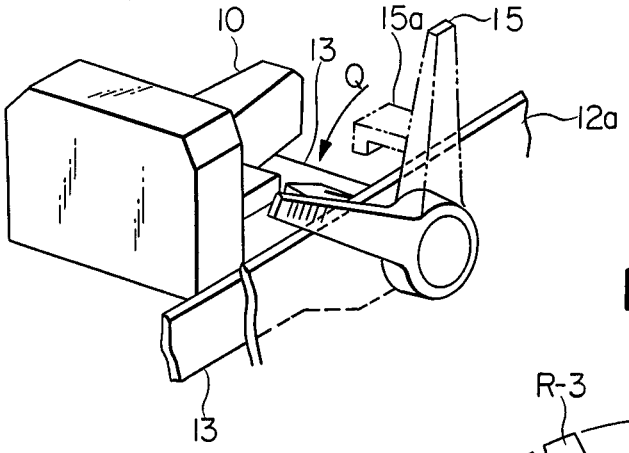

On the other hand, if the power source is not thrown to the unit, the carriage 13 will move freely in the direction of the arrow mark "X", but at this moment if the carriage 13 is moved toward side plate 12*a* by hand and the copy lever is thrown in the direction of the arrow mark "Q" as illustrated in FIG. 4, the hook-shaped projecting member 15*a* of copy lever 15 engages from above with the projecting member 13*a* which is formed on the side portion of carriage 13, and the movement of carriage 13 in the direction of the arrow mark "X" direction is restricted.

Figure 5:
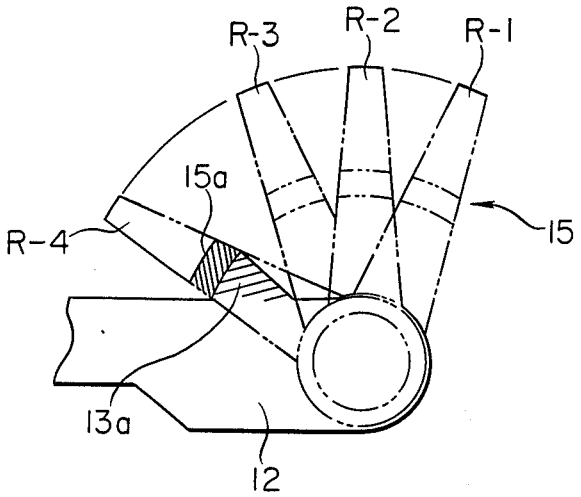

FIG. 5 is a view for explaining the functions of copy lever 15 by position in the printer of this embodiment.

If the copy lever 15 is at the position ranging from R-1 through R-3 in the figure, the lever serves to displace the guide rail 11 relative to the platen roller 14, increases or decreases the gap between the tip of a printing head 10 and the surface of the paper, and controls the printing power, but if the lever is thrown to the position of R-4, the projecting member 15*a* engages with the projecting member 13*a* of carriage 13 as earlier mentioned, and the movement of carriage 13 is restricted.

Thus, in the printer according to this embodiment, if the carriage 13 is pushed aside toward the side frame 12*a* and the copy lever 15 is thrown to the position of R-4 before moving the printer, the carriage 13 will not get displaced even if any vibrations should be applied to the unit, thereby protecting the printing head 10 and the carriage 11 from being damaged.

Further, since the copy lever and the carriage are generally made of a synthetic resin, it is easy to provide another type of projecting member, and the rise in production cost coming from the embodiment of this invention can be decreased.

What is more, though the projecting member 15*a* is provided on the copy lever 15 in the unit according to this embodiment, it must be understood that this invention should not be confined to this arrangement alone.

For example, it is also acceptable to provide the lever having a projecting member similar to the projecting member 15*a* in the vicinity of end portion of guide rail 11 in the side frame 12*a* of the printer.

Figure 6:
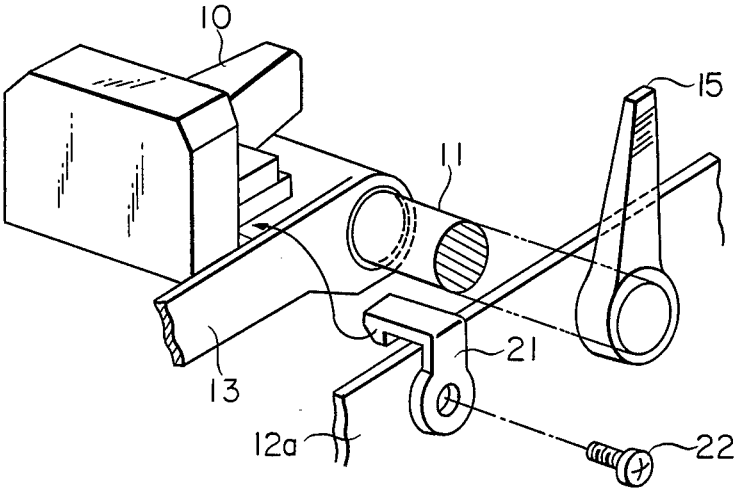
Figure 7:
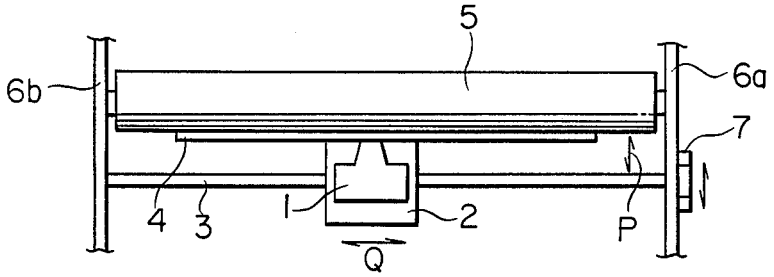
FIG. 7 PRIOR ART
Figure 8:
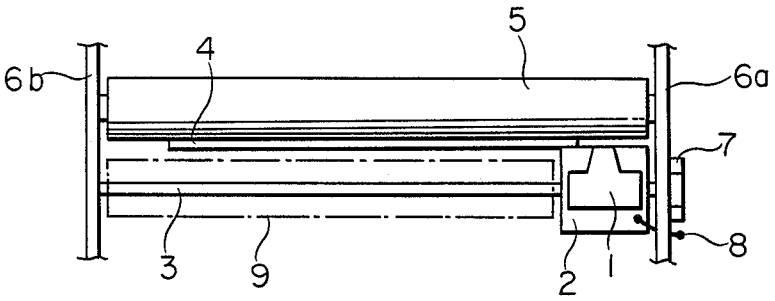
FIG. 8 PRIOR ART

Further, it is also acceptable, as shown in FIG. 6, to directly fasten the hook-shaped projecting member 21 with use of screw 22 in the vicinity of the end portion of guide rail 11 in the side frame 12*a* so that the projecting member 21 can be engaged with the carriage 13 when the carriage 13 is pushed in the direction of side frame 12*a*.

What is more, though the printing head in the printer according to this embodiment is of wire dot impact system, the printing head can be of other types of printing system.

As explained in the above, because, in the printer according to this invention, the locking member for locking the carriage temporarily to the given position of guide rail is provided, the carriage can be kept locked as necessary without the need for using the wire-bundling belt or the locking member, as was necessitated in the past.

What is claimed is:

1. A printer, comprising:

a pair of spaced-apart side frames;

a platen roller extending between and connected to said side frames;

a guide rail extending between and connecting to said side frames, said guide rail being substantially parallel to said platen roller;

a carriage mounted on said guide rail and slidably movable along said guide rail between said side frames, said carriage carrying a printing head spaced apart from said platen roller;

means for adjusting the spacing between said printing head and said platen roller, said adjusting means including a copy lever connected to said guide rail and pivotally mounted on one of said side frames; and means for temporarily locking said carriage in a locked position on said guide rail adjacent said one side frame, said locking means including a hook-shaped projecting member mounted on said copy lever, said copy lever being pivotable to a locking position in which said projecting member engages said carriage at times when said carriage is in said locked position, said projecting member preventing said carriage from moving out of said locked position.

2. The printer of claim 1, wherein said copy lever is connected to said guide rail via an eccentric cam.

* * * * *